US011268342B2

(12) United States Patent
Andersen

(10) Patent No.: US 11,268,342 B2
(45) **Date of Patent: *Mar. 8, 2022**

(54) SWELLABLE PACKER WITH REINFORCEMENT AND ANTI-EXTRUSION FEATURES

(71) Applicant: Halliburton Energy Services, Inc., Houston, TX (US)

(72) Inventor: Kristian Andersen, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,940

(22) Filed: May 14, 2019

(65) Prior Publication Data

US 2019/0264532 A1 Aug. 29, 2019

Related U.S. Application Data

(63) Continuation of application No. 14/783,067, filed as application No. PCT/US2013/040244 on May 9, 2013, now Pat. No. 10,287,846.

(51) Int. Cl.
*E21B 33/12* (2006.01)
*E21B 33/13* (2006.01)

(52) U.S. Cl.
CPC ..... *E21B 33/1208* (2013.01); *E21B 33/1216* (2013.01); *E21B 33/12* (2013.01); *E21B 33/13* (2013.01)

(58) Field of Classification Search
CPC .. E21B 33/1208; E21B 33/1216; E21B 33/13; E21B 33/12
See application file for complete search history.

(56) References Cited

U.S. PATENT DOCUMENTS 2,057,859 A 10/1936 Thaheld
2,069,212 A 2/1937 Buffington
(Continued)

FOREIGN PATENT DOCUMENTS

EA 010849 12/2008
EP 2410120 A2 1/2012
(Continued)

OTHER PUBLICATIONS

PCT International Search Report and Written Opinion dated Feb. 12, 2014, issued on corresponding PCT International Application No. PCT/US2013/040244 filed May 9, 2013.
(Continued)

*Primary Examiner* — Giovanna Wright
*Assistant Examiner* — Jonathan Malikasim
(74) *Attorney, Agent, or Firm* — Conley Rose, P.C.; Rodney B. Carroll

(57) ABSTRACT

A packer assembly for use in a subterranean well can include a seal element which swells in the well, a reinforcement in the seal element, and an extrusion barrier which displaces outward in response to swelling of an end portion of the seal element, the reinforcement being longitudinally spaced apart from the end portion of the seal element. A method of constructing a packer assembly can include positioning a reinforcement in a seal element which swells in response to contact with a fluid, the positioning including longitudinally spacing opposite ends of the reinforcement away from opposite end portions of the seal element, and installing extrusion barriers which radially outwardly overlie the seal element end portions.

8 Claims, 3 Drawing Sheets

(56) References Cited

U.S. PATENT DOCUMENTS

| | | | | |
|---|---|---|---|---|
| 2,184,634 | A * | 12/1939 | Crickmer | E21B 33/1208 277/341 |
| 2,254,060 | A * | 8/1941 | Crickmer | E21B 33/1208 277/337 |
| 6,725,934 | B2 * | 4/2004 | Coronado | E21B 33/1208 166/313 |
| 7,665,537 | B2 * | 2/2010 | Patel | E21B 33/1208 166/387 |
| 7,849,930 | B2 * | 12/2010 | Chalker | E21B 33/1208 166/387 |
| 7,938,176 | B2 | 5/2011 | Patel | |
| 8,051,914 | B2 * | 11/2011 | Freyer | E21B 43/103 166/387 |
| 8,119,047 | B2 | 2/2012 | Moore et al. | |
| 8,141,626 | B2 | 3/2012 | Freyer | |
| 8,157,019 | B2 | 4/2012 | King et al. | |
| 8,839,874 | B2 * | 9/2014 | Bishop | E21B 33/128 166/387 |
| 10,287,846 | B2 * | 5/2019 | Andersen | E21B 33/1277 |
| 2009/0159265 | A1 | 6/2009 | Freyer | |
| 2010/0116496 | A1 | 5/2010 | Allen et al. | |
| 2012/0018143 | A1 | 1/2012 | Lembcke | |
| 2012/0031608 | A1 | 2/2012 | Lembcke et al. | |
| 2012/0217004 | A1 | 8/2012 | Yee et al. | |

FOREIGN PATENT DOCUMENTS

| | | | |
|---|---|---|---|
| RU | 108095 | U1 | 10/2011 |
| WO | WO-2008/033115 | | 3/2008 |
| WO | WO-2008109148 | A1 | 9/2008 |
| WO | WO-2010/056636 | A1 | 5/2010 |

OTHER PUBLICATIONS

Office Action issued in corresponding Russian Application No. 2015142855 dated Jun. 2, 2017.

Russian Office Action dated Sep. 19, 2017 issued during the prosecution of Russian Patent Application No. 2015142855, 6 pages.

Mexican Office Action dated Nov. 7, 2018 issued in MX Application No. UX/a/2015/015118 and English translation.

* cited by examiner

SWELLABLE PACKER WITH REINFORCEMENT AND ANTI-EXTRUSION FEATURES

CROSS-REFERENCE TO RELATED APPLICATIONS

This Application is a Continuation of U.S. patent application Ser. No. 14/783,067 filed on Oct. 7, 2015, which is a U.S. National Stage application under 35 U.S.C. 371 of International Application No. PCT/US2013/040244 filed May 9, 2013. The entire contents of both of these applications are incorporated herein by reference in their entirety.

TECHNICAL FIELD

This disclosure relates generally to equipment utilized and operations performed in conjunction with a subterranean well and, in one example described below, more particularly provides a swellable packer with reinforcement and anti-extrusion features.

BACKGROUND

Swellable packers are known in the art as annular barriers which swell to seal off annular spaces in wells (such as, between a production tubing and a casing or wellbore wall, etc.). Swellable packers include seal elements which, after swelling, are subjected to pressure differentials across the seal elements in the annular spaces. Therefore, it will be readily appreciated that improvements are continually needed in the arts of constructing and utilizing swellable packers.

DETAILED DESCRIPTION

Figure 1:
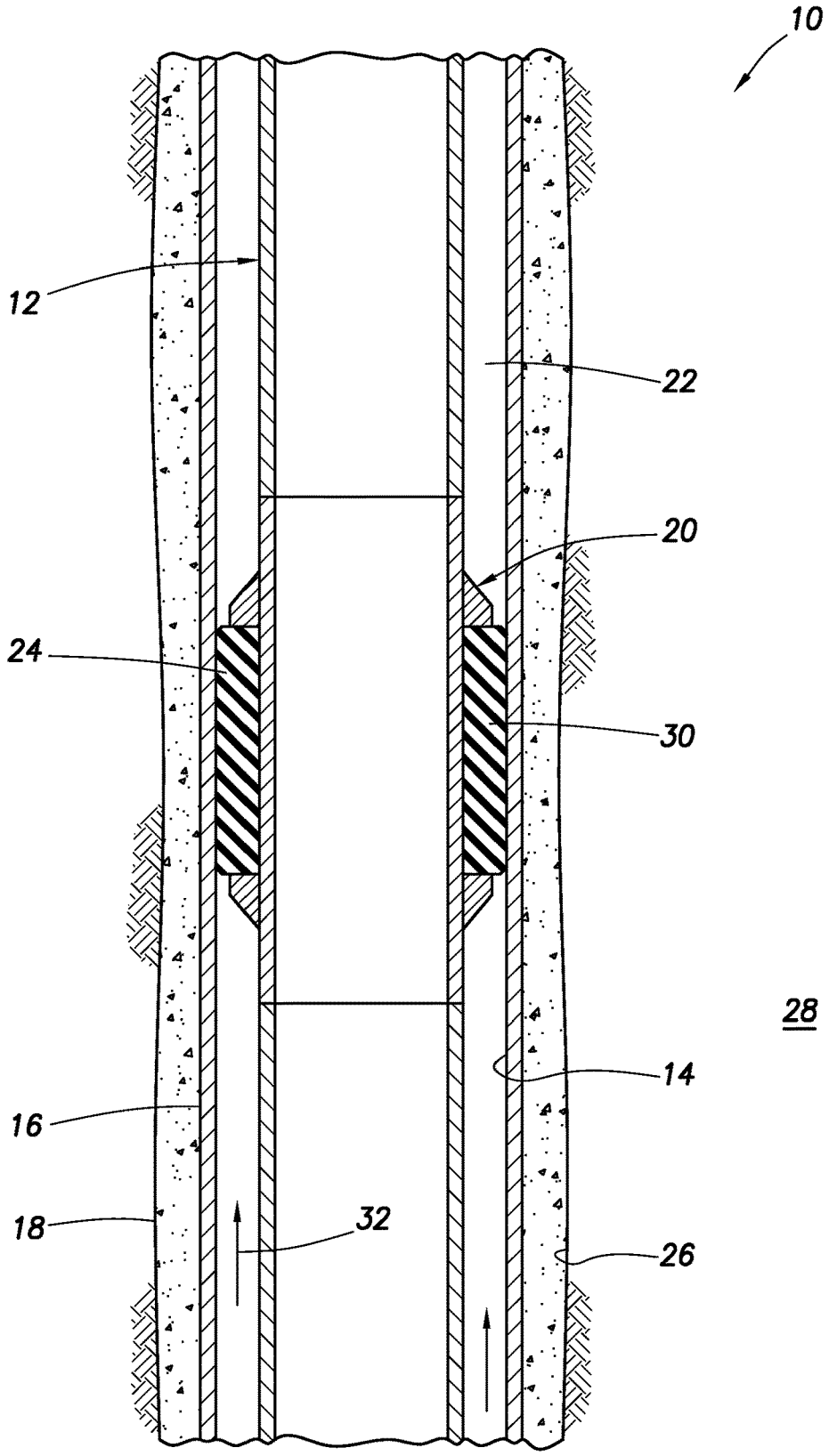
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14 lined with casing 16 and cement 18. In other examples, the wellbore 14 could be uncased or open hole, at least in a section where a packer assembly 20 is connected in the tubular string 12.

The packer assembly 20 is used to seal off an annulus 22 formed radially between the tubular string 12 and the wellbore 14. If the wellbore 14 is uncased or open hole, then an annular seal element 24 of the packer assembly 20 can sealingly engage an inner wall 26 of an earth formation 28 penetrated by the wellbore 14. However, it should be clearly understood that the scope of this disclosure is not limited to any particular surface or wall being sealingly contacted by the seal element 24.

The seal element 24 comprises a material 30 which swells when it is contacted by a particular fluid or fluids. Swelling of the material 30 causes the seal element 24 to extend radially outward into sealing contact with the wellbore 14.

Preferably, the swellable material 30 swells when it is contacted with a particular activating agent (e.g., oil, gas, other hydrocarbons, water, acid, other chemicals, etc.) in the well. The activating agent may already be present in the well, or it may be introduced after installation of the packer assembly 20 in the well, or it may be carried into the well with the packer assembly, etc. The swellable material 30 could instead swell in response to exposure to a particular temperature, or upon passage of a period of time, or in response to another stimulus, etc.

Thus, it will be appreciated that a wide variety of different ways of swelling the swellable material 30 exist and are known to those skilled in the art. Accordingly, the scope of this disclosure is not limited to any particular manner of swelling the swellable material 30. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 30 is in this example preferably a hydrocarbon fluid (such as oil or gas). In the well system 10, the swellable material 30 swells when a fluid 32 comprises the activating agent (e.g., when the fluid enters the wellbore 14 from the formation 28 surrounding the wellbore, when the fluid is circulated to the packer assembly 20 from the surface, when the fluid is released from a chamber carried with the packer assembly, etc.). In response, the seal element 24 seals off the annulus 22.

The activating agent which causes swelling of the swellable material 30 could be comprised in any type of fluid. The activating agent could be naturally present in the well, or it could be conveyed with the packer assembly 20, conveyed separately or flowed into contact with the swellable material 30 in the well when desired. Any manner of contacting the activating agent with the swellable material 30 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 30 may have a substantial portion of cavities therein which are compressed or collapsed at the surface condition. Then, after being placed in the well at a higher pressure, the material 30 is expanded by the cavities filling with fluid.

This type of apparatus and method might be used where it is desired to expand the swellable material 30 in the presence of gas rather than oil or water. A suitable swellable material is described in U.S. Published Application No. 2007-0257405, the entire disclosure of which is incorporated herein by this reference.

Preferably, the swellable material 30 used in the seal element 24 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 30 could also swell in response to contact with any of multiple activating agents. For example, the swellable material 30 could swell when contacted by hydrocarbon fluid, or when contacted by water.

Figure 2:
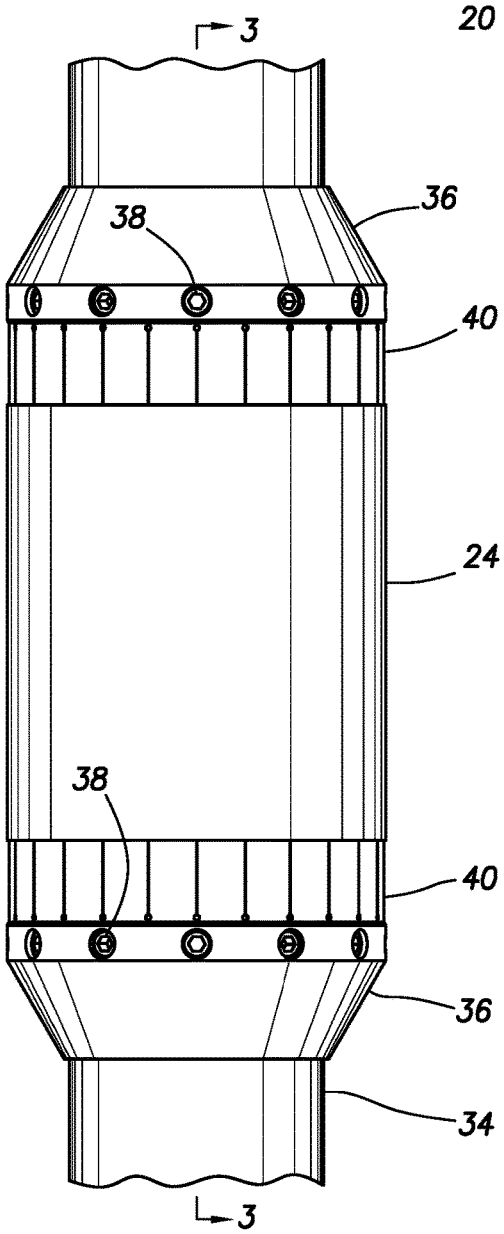
FIGS. 2 & 3 are representative elevational and cross-sectional views of a packer assembly which may be used in the system and method of FIG. 1, FIG. 3 being taken along line 3-3 of FIG. 2.
Figure 3:
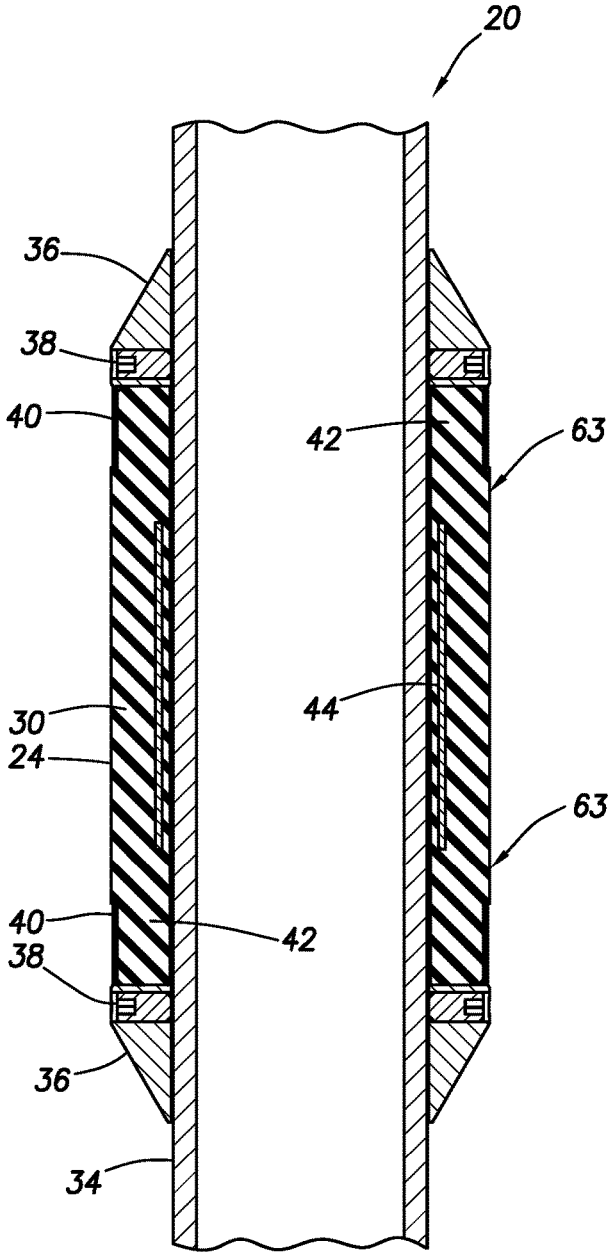

Referring additionally now to FIGS. 2 & 3, elevational and cross-sectional views of the packer assembly 20 are representatively illustrated. The packer assembly 20 may be used in the system 10 and method of FIG. 1, or the packer assembly may be used in other systems or methods.

In the FIGS. 2 & 3 example, the seal element 24 is longitudinally retained on a base pipe 34 by end rings 36. In this example, the end rings 36 are secured to the base pipe 34 with set screws 38, but other techniques (such as welding, clamping, etc.) may be used as desired. The scope of this disclosure is not limited to any particular details of the end rings 36, or to any particular manner of securing the end rings on the base pipe 34.

Extrusion barriers 40 radially outwardly overlie opposite end portions 42 of the seal element 24. When the seal element end portions 42 swell, the extrusion barriers 40 are bent outward, so that they bridge extrusion gaps formed between the end rings 36 and the wellbore 14. This prevents extrusion of the seal element 24 through the extrusion gaps due to differential pressure across the seal element.

A reinforcement 44 is embedded in the seal element 24. In this example, the reinforcement 44 is in the form of a metal sleeve embedded or molded into the seal element 24. However, in other examples, the reinforcement 44 could be made of other material(s), and the reinforcement could be otherwise shaped. Thus, the scope of this disclosure is not limited to any particular details of the reinforcement 44 as depicted in the drawings or described herein.

The reinforcement 44 prevents buckling of the seal element 24 and helps to retain the seal element on the base pipe 34. For example, when swelling of the seal element 24 begins, the swellable material 30 radially between the reinforcement 44 and the base pipe 34 will also swell, thereby causing the seal element to grip the base pipe.

Note that the reinforcement 44 extends longitudinally in the seal element 24, but does not extend an entire length of the seal element. Instead, the reinforcement 44 is longitudinally spaced apart from the end portions 42 of the seal element.

In this manner, swelling of the seal element end portions 42 are not restricted at all by the reinforcement 44. The seal element end portions 42 can readily swell outward to sealingly contact the wellbore 14, and to outwardly extend the extrusion barriers 40 at opposite ends of the seal element 24.

Figure 5:
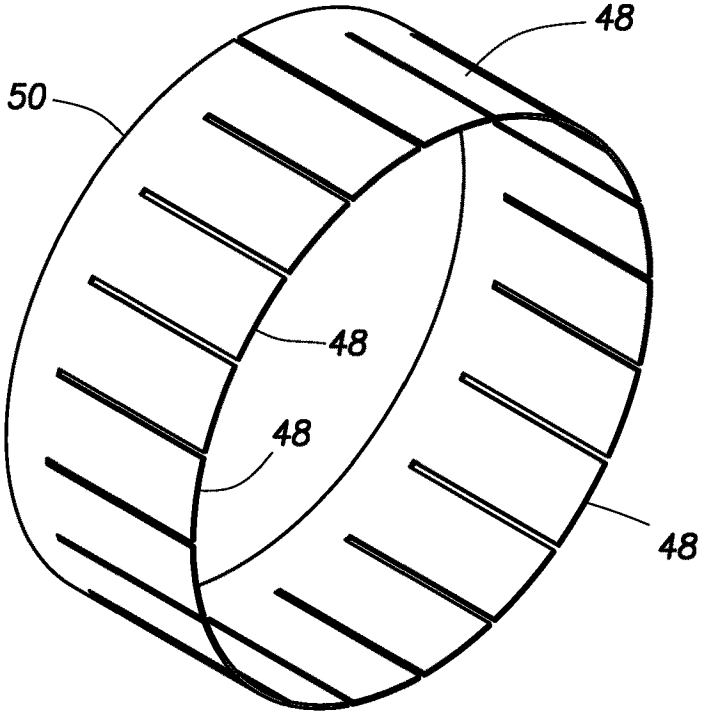
FIG. 5 is a representative perspective view of an extrusion barrier portion of the packer assembly.
Figure 4:
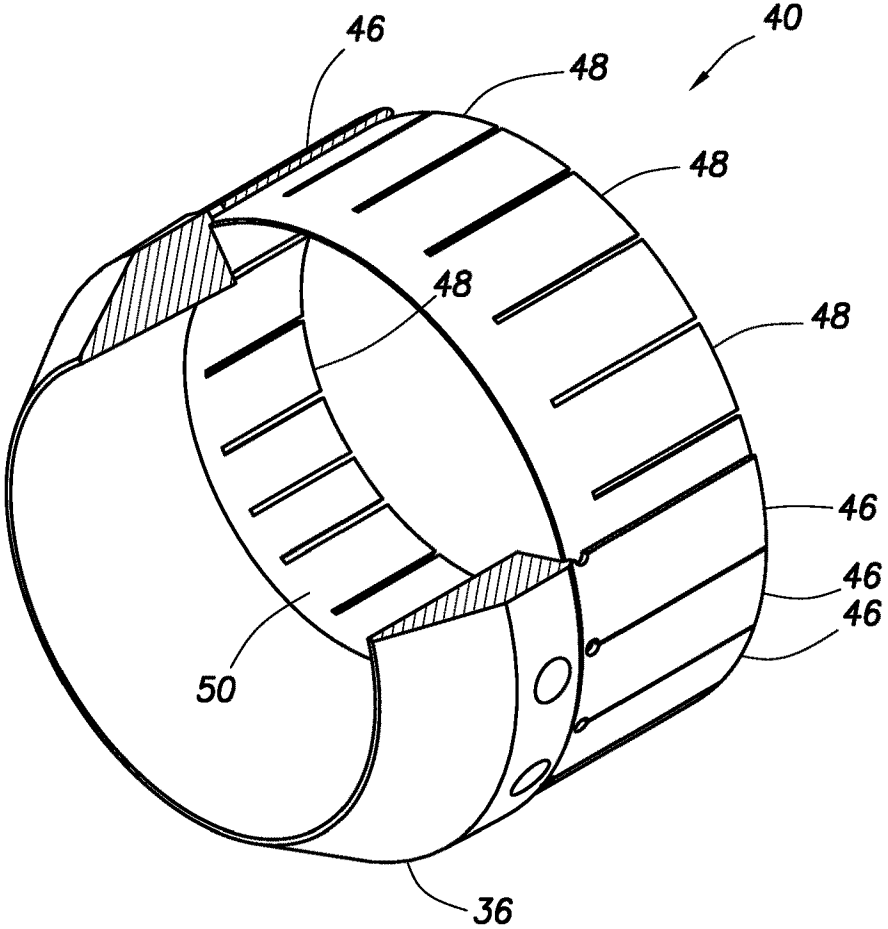
FIG. 4 is a representative perspective view of an end ring and extrusion barrier of the packer assembly.

Referring additionally now to FIGS. 4 & 5, an end ring 36 and extrusion barrier 40 are representatively illustrated, apart from the remainder of the packer assembly 20. In FIG. 4, it may be seen that the extrusion barrier 40 includes longitudinally extending and circumferentially distributed leaves or petals 46 formed on the end ring 36.

The extrusion barrier 40 also includes longitudinally extending and circumferentially distributed leaves or petals 48 formed on a sleeve 50 received in the petals 46 on the end ring 36. The petals 46, 48 are arranged, so that each petal extends across a gap between petals underlying or overlying that petal, thereby forming a complete barrier to extrusion of the seal element 24 when it swells.

As depicted in FIG. 3, the extrusion barriers 40 radially outwardly overlie the end portions 42 of the seal element 24. Thus, when the seal element end portions 42 swell, the extrusion barriers 40 will be readily displaced outward by the seal element end portions, so that the extrusion barriers contact the wellbore 14 and bridge the extrusion gaps between the end rings 36 and the wellbore.

It may now be fully appreciated that the above disclosure provides significant advancements to the arts of constructing and utilizing swellable packers in wells. In an example described above, the seal element 24 of the packer assembly 20 has a reinforcement 44 therein, but the reinforcement does not hinder swelling of end portions 42 of the seal element, and allows the extrusion barriers 40 to readily displace to close off extrusion gaps.

A packer assembly 20 for use in a subterranean well is described above. In one example, the packer assembly 20 can include a seal element 24 which swells in the well, a reinforcement 44 in the seal element 24, and an extrusion barrier 40 which displaces outward in response to swelling of an end portion 42 of the seal element 24. The reinforcement 44 is longitudinally spaced apart from the end portion 42 of the seal element 24.

The reinforcement 44 may comprise a metal sleeve. The seal element 24 can be disposed both radially inward and outward relative to the reinforcement 44.

The end portion 42 of the seal element 24 may underlie the extrusion barrier 40. The extrusion barrier 40 can comprise multiple circumferentially distributed petals 46, 48 secured to an end ring 36, the end ring 36 preventing longitudinal displacement of the seal element 24 relative to a base pipe 34.

The reinforcement 44 may be longitudinally spaced apart from the extrusion barrier 40, forming a longitudinal gap 63. The seal element 24 may swell in response to contact with a fluid 32.

A method of constructing a packer assembly 20 for use in a subterranean well is also described above. In one example, the method can comprise: positioning a reinforcement 44 in a seal element 24 which swells in the well, the positioning including longitudinally spacing opposite ends of the reinforcement 44 away from opposite end portions 42 of the seal element 24; and installing extrusion barriers 40 which radially outwardly overlie the seal element end portions 42.

Also described above is a well system 10, which can include a packer assembly 20 disposed in a subterranean well. The packer assembly 20 may include a seal element 24 which swells in response to contact with a fluid 32, a reinforcement 44 in the seal element 24, and an extrusion barrier 40 which overlies an end portion 42 of the seal element 24. The reinforcement 44 is longitudinally spaced apart from the end portion 42 of the seal element 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer assembly for use in a subterranean well, the packer assembly comprising:

a seal element which swells in the well;

a reinforcement in the seal element, wherein the reinforcement comprises a single unitary cylindrical metal sleeve having opposite ends; and two extrusion barriers positioned at respective end portions of the seal element, wherein each extrusion barrier displaces outward in response to swelling of one of the respective end portions of the seal element, the reinforcement being longitudinally spaced apart from each respective end portion of the seal element, wherein the extrusion barrier and the reinforcement are entirely non-overlapping in a longitudinal direction, wherein each opposite end of the reinforcement is longitudinally spaced apart from the respective extrusion barrier closest thereto to define a longitudinal gap between each extrusion barrier and the reinforcement;

wherein the seal element is disposed both radially inward and outward relative to the reinforcement and the end portion of the seal element underlies the extrusion barrier; and wherein the seal element fills the longitudinal gap and swells in response to contact with a fluid.

2. The packer assembly of claim 1, wherein the extrusion barriers each comprise multiple circumferentially distributed petals secured to an end ring, the end rings preventing longitudinal displacement of the seal element relative to a base pipe.

3. A method of constructing a packer assembly for use in a subterranean well, the method comprising:

positioning a reinforcement in a seal element which swells in the well, wherein the reinforcement comprises a single unitary cylindrical metal sleeve having opposite ends, the positioning including longitudinally spacing opposite ends of the reinforcement away from opposite end portions of the seal element; and installing two extrusion barriers, each of which radially outwardly overlie respective end portions of the seal element, wherein installing the extrusion barriers includes positioning two extrusion barriers relative to the reinforcement such that the extrusion barriers and the reinforcement are entirely non-overlapping in a longitudinal direction, wherein each opposite end of the reinforcement is longitudinally spaced apart from the respective extrusion barrier closest thereto to define a longitudinal gap between each extrusion barrier and the reinforcement;

wherein the seal element is disposed both radially inward and outward relative to the reinforcement and the end portion of the seal element underlies the extrusion barrier; and wherein the seal element fills the longitudinal gap and swells in response to contact with a fluid.

4. The method of claim 3, wherein the extrusion barriers each displaces outward in response to swelling of the seal element end portions.

5. The method of claim 3, wherein the extrusion barriers each comprise multiple circumferentially distributed petals secured to an end ring, the end rings preventing longitudinal displacement of the seal element relative to a base pipe.

6. A well system, comprising:

a packer assembly disposed in a subterranean well, the packer assembly including a seal element which swells in response to contact with a fluid, a reinforcement in the seal element wherein the reinforcement comprises a single unitary cylindrical metal sleeve having opposite ends, and two extrusion barriers positioned at respective end portions of the seal element, wherein each extrusion barrier overlies a respective one of the end portions of the seal element, wherein the reinforcement is longitudinally spaced apart from each respective end portion of the seal element, wherein the extrusion barrier and the reinforcement are entirely non-overlapping in a longitudinal direction, wherein each opposite end of the reinforcement is longitudinally spaced apart from the respective extrusion barrier closest thereto to define a longitudinal gap between each extrusion barrier and the reinforcement;

wherein the seal element is disposed both radially inward and outward relative to the reinforcement and the end portion of the seal element underlies the extrusion barrier; and wherein the seal element fills the longitudinal gap and swells in response to contact with the fluid.

7. The system of claim 6, wherein the extrusion barriers each comprise multiple circumferentially distributed petals secured to an end ring, the end rings preventing longitudinal displacement of the seal element relative to a base pipe.

8. The system of claim 6, wherein the extrusion barriers each displaces outward in response to swelling of the end portion of the seal element.

* * * * *